United States Patent [19]

Cohen

[11] 4,256,596

[45] Mar. 17, 1981

[54] OXIDATIVELY COUPLED HYDROXYAROMATIC COMPOUNDS AND FUELS AND LUBRICANTS CONTAINING THEM

[75] Inventor: Jerome M. Cohen, University Hts., Ohio

[73] Assignee: The Lubrizol Corporation, Wickliffe, Ohio

[21] Appl. No.: 78,858

[22] Filed: Sep. 26, 1979

Related U.S. Application Data

[63] Continuation-in-part of Ser. No. 931,788, Aug. 7, 1978, abandoned, which is a continuation-in-part of Ser. No. 735,248, Oct. 26, 1976, abandoned.

[51] Int. Cl.[3] ..... C10M 1/20; C10M 3/14; C10L 1/18; C07C 43/02

[52] U.S. Cl. ..... 252/52 R; 44/78; 252/404; 568/635; 568/730

[58] Field of Search ..... 252/52 R, 404; 44/78; 568/635, 730

[56] References Cited

U.S. PATENT DOCUMENTS

| | | | |
|---|---|---|---|
| 2,555,371 | 6/1951 | Prutton | 260/512 |
| 2,940,929 | 6/1960 | Diamond | 252/33.6 |
| 3,006,852 | 10/1961 | Barnum et al. | 252/52 R |
| 3,054,773 | 9/1962 | Wilgus | 260/61 |
| 3,122,575 | 2/1964 | Peterson et al. | 260/404 |
| 3,203,997 | 8/1965 | Mahoney et al. | 260/613 |
| 3,231,499 | 1/1966 | Smith | 252/57 |
| 3,240,817 | 3/1966 | Carlson | 260/613 |
| 3,247,245 | 4/1966 | Teot et al. | 260/512 |
| 3,306,875 | 2/1967 | Hay | 260/47 |
| 3,441,615 | 4/1969 | Merica | 260/613 |
| 3,451,061 | 6/1969 | Blake et al. | 260/613 |
| 3,476,815 | 11/1969 | Williams et al. | 260/613 |
| 3,539,646 | 11/1970 | Dannels et al. | 260/613 |
| 3,567,783 | 3/1971 | Brown | 260/613 |
| 3,759,831 | 9/1973 | Andress | 44/78 |
| 3,819,579 | 6/1974 | Van Der Voort | 252/52 R |
| 3,860,661 | 1/1975 | Hammann et al. | 252/52 R |
| 3,876,709 | 4/1975 | Lee et al. | 252/46.3 |
| 3,928,355 | 12/1975 | Lee | 260/268 |
| 3,970,640 | 7/1976 | Yonemitsu et al. | 260/47 ET |
| 3,986,981 | 10/1976 | Lyons | 252/404 |

*Primary Examiner*—Delbert E. Gantz
*Assistant Examiner*—Irving Vaughn
*Attorney, Agent, or Firm*—William H. Pittman; Daniel N. Hall; Raymond F. Keller

[57] ABSTRACT

Mixtures of (A) hydroxyaromatic compounds (e.g., phenols) having no aliphatic substituents of more than 4 carbon atoms and (B) hydroxyaromatic compounds having at least one aliphatic substituent with at least about 12 carbon atoms may be oxidatively coupled to yield products useful as lubricant and fuel additives.

30 Claims, No Drawings

OXIDATIVELY COUPLED HYDROXYAROMATIC COMPOUNDS AND FUELS AND LUBRICANTS CONTAINING THEM

This application is a continuation-in-part of copending application Ser. No. 931,788, filed Aug. 7, 1978, which in turn is a continuation-in-part of application Ser. No. 735,248, filed Oct. 26, 1976, both now abandoned.

This invention relates to new compositions of matter suitable for oxidative coupling, to oxidatively coupled products prepared from such compositions and a method for their preparation, and to additive concentrates, lubricants and fuels containing such products. More specifically, the oxidatively coupled products of this invention are prepared from a reaction mixture comprising:

(A) At least one hydroxyaromatic compound containing no aliphatic substituent having more than 4 carbon atoms; and (B) at least one hydroxyaromatic compound containing at least one aliphatic substituent having at least about 12 carbon atoms;

at least one position ortho to a hydroxy group in each of reagents A and B being unsubstituted.

Methods and reagents for oxidative coupling of hydroxyaromatic compounds are disclosed in Taylor et al., *Oxidative Coupling of Phenols* (Marcel Dekker, Inc., 1967); in Patai, *The Chemistry of the Hydroxyl Group,* chapters 10 and 16 (Interscience Publishers, 1971); and in many U.S. patents including the following:

U.S. Pat. No. 3,306,875
U.S. Pat. No. 3,630,900
U.S. Pat. No. 3,631,208
U.S. Pat. No. 3,772,373
U.S. Pat. No. 3,819,579
U.S. Pat. No. 3,873,627
U.S. Pat. No. 3,876,709
U.S. Pat. No. 3,928,355
U.S. Pat. No. 3,959,223
U.S. Pat. No. 3,970,640

These publications are incorporated by reference herein for their disclosure of the oxidative coupling reaction and reagents used therein. In general, this reaction comprises the oxidation of hydroxyaromatic compounds in the presence of reagents which promote the formation of carbon-to-carbon or carbon-to-oxygen bonds linking aromatic rings. The precise molecular structure of the resulting products may not be readily identifiable and it is often most convenient to define the products in terms of the process for their preparation.

The products of this invention are prepared by oxidative coupling of a mixture of at least two different types of hydroxyaromatic compounds. The first type, frequently referred to herein as "reagent A", contains one or more aromatic rings and no aliphatic substituent having more than 4 carbon atoms. If any aliphatic substituents are present, they are generally alkyl groups. If more than one aromatic ring is present, the rings may be fused, linked by direct carbon-to-carbon bonds, or linked through other atoms such as oxygen or carbon. Compounds containing more than one hydroxy group attached to the aromatic moieties are included, as are compounds containing other substituents such as halogen, alkyl, hydroxyalkyl, alkoxy or alkylthio (so long as any alkyl groups therein contain no more than 4 carbon atoms). It is essential, however, that the hydroxyaromatic compounds contain at least one unsubstituted position ortho to a hydroxy group. Suitable hydroxyaromatic compounds include phenol, m-cresol, p-cresol, p-ethylphenol, α-naphthol, β-naphthol, 4-methyl-α-naphthol, p-chlorophenol, o-methoxyphenol, catechol, resorcinol, hydroquinone, hydroxybiphenyl and bisphenol A.

A preferred subgenus of compounds useful as reagent A has the formula

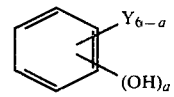

wherein a is 1 or 2, usually 1; each Y is individually hydrogen, halo, alkyl or hydroxyalkyl or haloalkyl of up to 4 carbon atoms, or alkoxy or alkylthio of up to 4 carbon atoms; and at least one and preferably two positions ortho to a hydroxy group are unsubstituted. Most often, up to two Y's (preferably none) are alkyl or hydroxyalkyl radicals having up to 2 carbon atoms and all others are hydrogen. It is also preferred that the positions adjacent to the previously mentioned unsubstituted ortho positions not contain bulky substituents such as t-butyl or phenyl groups which would tend to inhibit oxidative coupling in those positions.

The second type of hydroxyaromatic compound, frequently referred to herein as "reagent B", is in most respects similar to reagent A but differs therefrom in that its molecules contain at least one (usually only one) aliphatic substituent having at least about 12 carbon atoms. The aliphatic substituent may be bound to the aromatic radical through a direct carbon-to-carbon bond or through a hetero atom such as oxygen or sulfur; the direct carbon-to-carbon bond is preferred.

The aliphatic substituent in reagent B is usually substantially saturated. By "substantially saturated" is meant that it is free of acetylenic unsaturation and has no more than one olefinic bond for each 12 carbon atoms, usually no more than one olefinic bond for each 25 aliphatic carbon atoms. It is ordinarily an aliphatic hydrocarbon radical, but it may also contain non-aliphatic hydrocarbon substituents such as phenyl, hydroxy, nitro, carbalkoxy, alkoxy, cyano, halo and the like. In general, no more than one such substituent is present for every 5 and usually for every 25 carbon atoms.

A preferred subgenus of compounds useful as reagent B has the formula

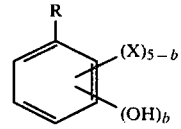

wherein b is 1 or 2, usually 1; each X is individually hydrogen, halo, alkyl or hydroxyalkyl or haloalkyl of up to 4 carbon atoms, or alkoxy or alkylthio of up to 4 carbon atoms; R is na aliphatic radical having at least about 12 carbon atoms; and at least one and preferably two positions ortho to a hydroxy group are unsubstituted. As will be apparent, this subgenus of preferred compounds differs from the subgenus preferred as reagent A in the presence of the aliphatic radical R. The R group is most desirably para to the hydroxy group.

Most often, up to two X's (preferably none) are alkyl or hydroxyalkyl radicals having up to 2 carbon atoms and all others are hydrogen; also, the preference expressed with reference to reagent A for the absence of bulky substituents applies equally to reagent B.

Illustrative aliphatic substituents on reagent B, and present as R in the formula for the preferred subgenus, are n-dodecyl, tetrapropenyl, n-octadecyl, oleyl, chlorooctadecyl, triacontanyl and the like. The R radical preferably contains at least about 40 carbon atoms, in which case it is most often derived from an olefin polymer such s polypropylene, polybutene, ethylene-propylene copolymer, butene-isoprene copolymer and the like. These polymers usually have a number average molecular weight between about 500 and about 15,000 preferably between about 600 and about 5,000 and most desirably between about 800 and about 3,000, as determined by vapor phase osmometry. Especially preferred aliphatic radicals are those derived from polybutenes containing predominantly isobutene units.

Referring to the preferred structural formula for component B, compounds of this type may be readily prepared from hydroxyaromatic compounds containing no R substituents by alkylation by known methods. The invention also contemplates the use as reagent B of the product of a previous oxidative coupling reaction according to the invention.

The ratio of reagent A to reagent B can vary widely; for example, about 0.1–20 moles of reagent A per mole or reagent B. The preferred range is from about 0.2 to about 20 moles, most desirably from about 0.33 to about 15 moles, of reagent A per mole of reagent B.

The oxidatively coupled products of this invention are prepared by reacting the above-described mixtures of hydroxyaromatic compounds with an oxidative coupling agent. Suitable oxidative coupling agents are known to those skilled in the art. They include, for example, molecular oxygen in combination with copper salts and amines; ferric iron compounds such as potassium ferricyanide and ferric chloride; tetravalent lead compounds such as lead tetraacetate and lead dioxide; peroxy compounds such as hydrogen peroxide, alkyl peroxide, acyl peroxide and persulfates; periodates; Fremy's salt; silver oxide; nickel dioxide; halogens such as chlorine and bromine; potassium permanganate and other permanganates; and mixtures of potassium dichromate and manganese acetate. Other suitable oxidative coupling agents and methods for their use are described in the textbooks and patents previously incorporated by reference.

For the purpose of this invention, it is preferred to use as an oxidative coupling agent molecular oxygen or air in the presence of a catalyst prepared by combining a copper salt with an amine. The amine used in the preparation of the catalyst may be primary, secondary or tertiary, and may be a monoamine or a polyamine. Aliphatic (including arylaliphatic), alicyclic and heterocyclic amines are preferred; these include trimethylamine, triethylamine, tripropylamine, benzyldiamylamine, ethylisopropylamine, 4-pentenyldimethylamine, methyl(cyclohexyl)amine, octyl(chlorobenzyl)amine, methyl(phenethyl)amine, 1-ethylamino-2-phenylheptane, benzyl(dihexyl)amine, 2-methyloctyldiethylamine, pyridine, pyrrole, pyrrolidine, piperidine, isoquinoline, morpholine, and substituted derivatives of the above-named heterocyclic amines. Tertiary amines and especially tertiary heterocyclic amines such as the pyridines are preferred.

The copper salt component of the catalyst may be any copper salt which forms a soluble of dispersible complex with the amine. Suitable copper salts include cuprous and cupric halides and sulfates. The cuprous salts, and especially cuprous chloride, are preferred.

The copper salt-amine catalyst is normally prepared as a complex either prior to addition to the mixture to be oxidatively coupled, or in situ in said mixture by adding the copper salt and amine separately thereto. The relative proportions of copper salt and amine in the catalyst complex are known to those skilled in the art and are disclosed, for example, in the aforementioned U.S. Pat. Nos. 3,306,875; 3,630,900; 3,631,208; and 3,959,223.

Compositions suitable for oxidative coupling are contemplated as one aspect of the present invention. These compositions comprise the hydroxyaromatic compounds previously identified as reagent A and reagent B in combination with the solid and liquid components of the oxidative coupling agent. (Gaseous components of the oxidative coupling agent, such as molecular oxygen, must be supplied separately when it is desired to initiate the coupling reaction). These compositions may also contain a substantially inert, normally liquid organic diluent such as an aliphatic or aromatic hydrocarbon, a chlorinated or nitrated aliphatic or aromatic compound, an ether or the like. Suitable diluents include benzene, toluene, xylene, chlorobenzene, o-dichlorobenzene, nitrobenzene, nonane, dodecane, mineral oil, chloroform and dibutyl ether. Aromatic compounds are especially preferred as diluents. It is also within the scope of the invention to use as a diluent an excess of the amine component of the oxidative coupling catalyst (e.g., pyridine).

The oxidative coupling reaction may be effected by contacting the hydroxyaromatic compounds with the oxidative coupling agent at a temperature high enough to initiate the reaction but not high enough to cause degradation of the reactants or product. Normally this temperature will be between about 20° C. and about 300° C., most often between about 75° C. and about 250° C. In cases where the oxidative coupling reaction is initiated at relatively low temperatures, it may be desirable to store the mixture comprising the hydroxyaromatic compounds and the oxidative coupling agent at low temperatures, such as under refrigeration. When the oxidative coupling agent comprises at least one gaseous reagent such as molecular oxygen, the mixture of the hydroxyaromatic compounds and the solid and liquid components of the oxidative coupling agent may be stored under normal ambient conditions until it is desired to initiate the reaction, whereupon air or oxygen is blown through the mixture in known manner.

The progress of the oxidative coupling reaction may often be monitored by measuring the viscosity of the reaction mixture, which generally increases at the reaction continues. When the reaction has progressed to the desired extent, the catalyst may be removed and the product isolated by removal of diluents (e.g., by vacuum stripping). If the diluent is a relatively non-volatile material such as mineral oil, its removal may be unnecessary and the product may be employed in solution as an additive for lubricants or fuels.

The preparation of the oxidatively coupled products of this invention is illustrated by the following examples. All parts are by weight; molecular weights are number average molecular weights and are determined by vapor phase osmometry. Polybutenyl moieties, where used, contain predominantly isobutene units.

EXAMPLE 1

A mixture of 1,666 parts of o-dichlorobenzene, 273 parts of a p-polybutenyl phenol (molecular weight 1200), 91 parts of phenol, 43 parts of magnesium sulfate, 71 parts of pyridine and 0.94 part of cuprous chloride is blown beneath the surface with air for 8 hours at 140° C. The resulting composition is cooled to room temperature, filtered and stripped to yield the desired oxidative coupling product.

EXAMPLE 2

A mixture of 3100 parts of o-dichlorobenzene, 48 parts of magnesium sulfate, 80 parts of pyridine and 1 part of cuprous chloride is heated to 75° C. as air is bubbled beneath the surface. A solution of 300 parts of p-polybutenyl phenol (molecular weight 1200) and 100 parts of phenol in 780 parts of o-dichlorobenzene is added and the mixture is heated at 140°-150° C. for 13 hours as air blowing is continued. Mineral oil, 500 parts, is added and the solution is filtered and stripped at 210° C. under vacuum to yield an oil solution of the desired oxidative coupling product.

EXAMPLE 3

A mixture of 1300 parts of o-dichlorobenzene, 39.5 parts of pyridine, 24 parts of magnesium sulfate and 0.495 part of cuprous chloride is heated to 70° C. as air is bubbled beneath the surface. To the mixture is added 64 parts of o-hexadecyl phenol and 3.2 parts of p-cresol. The mixture is heated at 70° C. for 4 hours as air blowing is continued. Diatomaceous earth, 40 parts, is added and the composition is filtered and stripped at 160° C. under vacuum. the residue is washed with a solution of 10 parts of concentrated hydrochloric acid in 1000 parts of methanol, filtered and stripped to yield the desired oxidative coupling product.

EXAMPLE 4

The procedure of Exampe 1 is repeated except the air blowing period is increased from 8 hours to 18 hours.

EXAMPLE 5

A mixture of 910 parts of o-dichlorobenzene, 24 parts of magnesium sulfate, 40 parts of pyridine and 0.5 parts of cuprous chloride is heated to 75° C. A solution of 100 parts of p-polybutenyl phenol (molecular weight 860) and 9.4 parts of phenol in 390 parts of o-dichlorobenzene is added and the mixture is heated at 140°-150° C. for 7 hours as air is bubbled beneath the surface. The mixture is filtered and stripped at 210° C. under vacuum. Xylene, 100 parts, is added to the filtrate to yield a xylene solution of the desired oxidative coupling product.

EXAMPLE 6

The procedure of Example 2 is repeated except the amount of phenol is increased to 200 parts.

EXAMPLE 7

To a mixture of 100 parts of sodium carbonate, 400 parts of water, 100 parts of ethanol and 165 parts of potassium ferricyanide is added a mixture of 300 parts of p-polybutenyl phenol (molecular weight 1200), 25 parts of phenol and 325 parts of mineral oil. The mixture is heated at 70° C. under nitrogen for 2 hours. Toluene, 1000 parts, is added and the solution is washed three times with water, stripped at 210° C. under vacuum and filtered to yield an oil solution of the desired oxidative coupling product.

EXAMPLE 8

A mixture of 300 parts of p-polybutenyl phenol (molecular weight 1200), 3100 parts of o-dichlorobenzene, 48 parts of magnesium sulfate, 80 parts of pyridine and 1 part of cuprous chloride is heated to 75° C. A solution of 100 parts of phenol in 780 parts of o-dichlorobenzene is added over 1 hour as the mixture is blown with air; air blowing is continued for 17 hours at 140°-160° C. Mineral oil, 500 parts, is added and the composition is filtered and stripped at 210° C. under vacuum to yield an oil solution of the desired oxidative coupling product.

EXAMPLE 9

A mixture of 510 parts of o-dichlorobenzene, 24 parts of magnesium sulfate (a drying agent used to remove water as it is formed), 40 parts of pyridine and 1 part of cuprous chloride is heated to 75° C. as air is bubbled beneath the surface. A solution of 105 parts of the oxidative coupling product of Example 6 and 25 parts of phenol in 300 parts of o-dichlorobenzene is added and the reaction mixture is heated at 140°-150° C. for 13 hours as air blowing is continued. Mineral oil, 50 parts, is added and the composition is filtered and stripped at 210° C. under vacuum to yield a xylene solution of the desired oxidative coupling product.

EXAMPLE 10

The procedure of Example 9 is repeated except the product of Example 6 is replaced with 232 parts of the product of Example 2.

EXAMPLE 11

The procedure of Example 1 is repeated except the o-dichlorobenzene is replaced with xylene on an equal weight basis.

EXAMPLES 12-21

Oxidatively coupled compositions are prepared from the reaction mixtures listed in the following table according to the general procedure of Example 1.

| Example | Reagent A Identity | Mol. wt. | Reagent B identity | Mole ratio, A:B |
|---|---|---|---|---|
| 12 | p-Polybutenyl phenol | 950 | Catechol | 1:3 |
| 13 | p-(p-Polybutenyl phenoxy) phenol | 1000* | Phenol | 1:4 |
| 14 | o-Polybutenyl phenol | 900 | o-Chlorophenol/phenol (equimolar mixture) | 3:5 |
| 15 | p-Polybutenyl phenol | 1300 | β-Naphthol | 1:5 |
| 16 | p-Tetrapropenyl phenol | | Xylenol | 6:1 |
| 17 | p-Polybutenyl phenol | 1800 | o-Cresol/p-cresol (equimolar mixture) | 1:5 |
| 18 | p-Polybutenyl phenol | 950 | Anisole | 1:8 |
| 19 | p-Polypropenyl phenol | 800 | Resorcinol | 1:2 |
| 20 | p-Polybutenyl phenol | 950 | Bisphenol A | 5:1 |
| 21 | Polybutenyl cresol | 1000 | Phenol | 1:3 |

*Molecular weight of polybutenyl radical.

As previously indicated, the oxidatively coupled products of this invention are useful as additives for lubricants, in which they function primarily as dispersants, oxidation inhibitors and viscosity modifiers. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes, poly(methylphenyl)siloxanes, etc.). Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants of the present invention contain an amount of the composition of this invention sufficient to provide dispersancy, oxidation inhibiting or viscosity modifying properties. Normally this amount will be from about 0.05% to about 20% , preferably from about 0.1% to about 10%, of the total weight of the lubricant.

The invention also contemplates the use of other additives in combination with the oxidative coupling products of this invention. Such additives include, for example, ash-producing detergents, auxiliary ashless dispersants, corrosion- and oxidation-inhibiting agents, pour point depressing agents, extreme pressure agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-β-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Auxiliary ashless detergents and dispersants are so called despite the fact that, depending on its constitution, the dispersant may upon combustion yield a nonvolatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen-containing compounds such as amine, organic hydroxy compounds such as phenols and alcohols, and/or basic inorganic materials. Examples of these "carboxylic dispersants" are described in British Pat. No. 1,306,529 and in many U.S. patents including the following:

U.S. Pat. No. 3,163,603
U.S. Pat. No. 3,351,552
U.S. Pat. No. 3,541,012
U.S. Pat. No. 3,184,474
U.S. Pat. No. 3,381,022
U.S. Pat. No. 3,542,678
U.S. Pat. No. 3,215,707
U.S. Pat. No. 3,399,141
U.S. Pat. No. 3,542,680
U.S. Pat. No. 3,219,666
U.S. Pat. No. 3,415,750
U.S. Pat. No. 3,567,637
U.S. Pat. No. 3,271,310
U.S. Pat. No. 3,433,744
U.S. Pat. No. 3,574,101
U.S. Pat. No. 3,272,746
U.S. Pat. No. 3,444,170
U.S. Pat. No. 3,576,743
U.S. Pat. No. 3,281,357
U.S. Pat. No. 3,448,048
U.S. Pat. No. 3,630,904
U.S. Pat. No. 3,306,908
U.S. Pat. No. 3,448,049
U.S. Pat. No. 3,632,510
U.S. Pat. No. 3,311,558
U.S. Pat. No. 3,451,933
U.S. Pat. No. 3,632,511
U.S. 3,316,177
U.S. Pat. No. 3,454,607
U.S. Pat. No. 3,697,428
U.S. Pat. No. 3,340,281
U.S. Pat. No. 3,467,668
U.S. Pat. No. 3,725,441
U.S. Pat. No. 3,341,542
U.S. Pat. No. 3,501,405
U.S. Pat. No. Re 26,433
U.S. Pat. No. 3,346,493
U.S. Pat. No. 3,522,179

(2) Reaction products of relatively high molecular weight aliphatic or alicyclic halides with amines, preferably polyalkylene polyamines. These may be characterized as "amine dispersants" and examples thereof are described for example, in the following U.S. patents:

U.S. Pat. No. 3,275,554
U.S. Pat. No. 3,454,555
U.S. Pat. No. 3,438,757
U.S. Pat. No. 3,565,804

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative:

U.S. Pat. No. 3,413,347
U.S. Pat. No. 3,725,480
U.S. Pat. No. 3,697,574
U.S. Pat. No. 3,726,882
U.S. Pat. No. 3,725,277

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

U.S. Pat. No. 3,036,003
U.S. Pat. No. 3,282,955
U.S. Pat. No. 3,493,520
U.S. Pat. No. 3,639,242
U.S. Pat. No. 3,087,936
U.S. Pat. No. 3,312,619
U.S. Pat. No. 3,502,677
U.S. Pat. No. 3,649,229
U.S. Pat. No. 3,200,107
U.S. Pat. No. 3,366,569
U.S. Pat. No. 3,513,093
U.S. Pat. No. 3,649,659
U.S. Pat. No. 3,216,936
U.S. Pat. No. 3,367,943
U.S. Pat. No. 3,533,945
U.S. Pat. No. 3,658,836
U.S. Pat. No. 3,254,025
U.S. Pat. No. 3,373,111
U.S. Pat. No. 3,539,633
U.S. Pat. No. 3,697,574
U.S. Pat. No. 3,256,185
U.S. Pat. No. 3,403,102
U.S. Pat. No. 3,573,010
U.S. Pat. No. 3,702,757
U.S. Pat. No. 3,278,550
U.S. Pat. No. 3,442,808
U.S. Pat. No. 3,579,450
U.S. Pat. No. 3,703,536
U.S. Pat. No. 3,280,234
U.S. Pat. No. 3,455,831
U.S. Pat. No. 3,591,598
U.S. Pat. No. 3,704,308
U.S. Pat. No. 3,281,428
U.S. Pat. No. 3,455,832

U.S. Pat. No. 3,600,372
U.S. Pat. No. 3,708,522

(5) Interpoalymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

U.S. Pat. No. 3,329,658
U.S. Pat. No. 3,666,730
U.S. Pat. No. 3,449,250
U.S. Pat. No. 3,687,849
U.S. Pat. No. 3,519,565
U.S. Pat. No. 3,702,300

The above-noted patents are incorporated by reference herein for their disclosures of ashless dispersants.

Extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The oxidative coupling products of this invention can also be used as dispersant and antioxidant additives in fuels. The fuel compositions of the invention contain a major proportion of a normally liquid fuel, usually a hydrocarbonaceous petroleum distillate fuel such as motor gasoline as defined by ASTM Specification D-439-73 and diesel fuel or fuel oil as defined by ASTM Specification D-396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Such mixtures include combinations of gasoline and ethanol, diesel fuel and ether, and the like. Particularly preferred is gasoline, that is, a mixture of hydrocarbons having an ASTM boiling point of about 60° C. at the 10% distillation point to about 205° C. at the 90% distillation point.

Generally, these fuel compositions contain an amount of the oxidative coupling product of this invention sufficient to impart dispersancy and oxidation resistant properties thereto; usually this amount is from about 1 to about 10,000, preferably from about 10 to about 5000, parts by weight of the oxidative coupling product per million parts of fuel.

The fuel compositions of this invention can contain, in addition to the oxidative coupling product, other additives which are well known to those of skill in the art. These can include antiknock agents such as tetraalkyl lead compounds, lead scavengers such as haloalkanes (e.g., ethylene dichloride and ethylene dibromide), deposit preventors or modifiers such as triaryl phosphates, dyes, cetane improvers, antioxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, anti-icing agents and the like.

The oxidative coupling products of this invention can be added directly to the fuel or lubricant. Preferably, however, they are diluted with a substantially inert, normally liquid organic diluent such as mineral oil, naphtha, benzene, toluene or xylene, to form an additive concentrate. These concentrates usually contain from about 20% to about 90% by weight of the oxidative coupling product of this invention and may contain, in addition, one or more other additives known in the art or described hereinabove.

The following are illustrative of lubricant and fuel compositions of this invention. All parts are by weight unless otherwise indicated.

| | | |
|---|---|---|
| Composition A (Crankcase lubricant) | | |
| Mineral oil | 81.45 | parts |
| Product of Example 1 | 6.5 | parts |
| Borated polybutenyl succinic anhydride-ethylene polyamine reaction product | 1 | part |
| Sulfurized lower alkyl cyclohexenyl-carboxylate | 1.3 | parts |
| Tetrapropenyl succinic acid | 0.5 | part |
| Poly-(isodecyl acrylate) | 7.75 | parts |
| Hindered phenol oxidation inhibitor | 1.5 | parts |
| Silicone anti-foam agent | 0.006 | part |
| Composition B (Automatic transmission fluid) | | |
| Alkylaromatic synthetic oil | 89.3 | parts |
| Mineral oil | 0.3 | part |
| Product of Example 9 | 6 | parts |
| Borated polybutenyl succinic anhydride-ethylene polyamine reaction product | 3 | parts |
| Zinc dialkylphosphorodithioate | 0.5 | part |
| Di-(lower alkyl) hydrogen phosphite | 0.1 | part |
| Sulfurized fatty oil-fatty acid-olefin mixture | 0.5 | part |
| Hindered amine antioxidant | 0.1 | part |
| Ethoxylated alkylamine friction modifier | 0.2 | part |
| Composition C (Middle distillate fuel) | | |
| Middle distillate fuel oil containing 50 parts per million of the product of Example 3. | | |
| Composition D (Gasoline fuel) | | |
| Gasoline containing 2 g. per gallon of lead as tetraethyl lead and 20 parts per million of the product of Example 5. | | |
| Composition E (Diesel fuel) | | |
| Diesel fuel oil containing 40 parts per million of the composition of Example 2. | | |

What is claimed is:

1. A method for preparing an oxidatively coupled product which comprises reacting an oxidative coupling agent with a reaction mixture comprising:

(A) At least one hydroxyaromatic compound containing no aliphatic substituent having more than 4 carbon atoms; and (B) at least one hydroxyaromatic compound containing at least one aliphatic substituent having at least about 12 carbon atoms;

at least one position ortho to a hydroxy group in each of reagents A and B being unsubstituted.

2. A method according to claim 1 wherein reagents A and B have the formulas

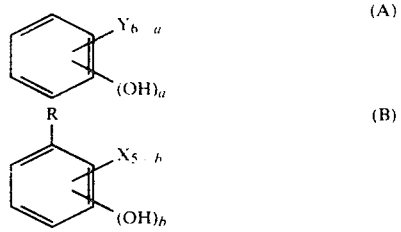

wherein R is an aliphatic radical having at least about 12 carbon atoms; each X and each Y is individually hydrogen, halo, alkyl or hydroxyalkyl or haloalkyl of up to 4 carbon atoms, or alkoxy or alkylthio of up to 4 carbon atoms; and each of a and b is 1 or 2.

3. A method according to claim 2 wherein R has at least about 40 carbon atoms.

4. A method according to claim 3 wherein R has a number average molecular weight between about 600 and about 5000.

5. A method according to claim 4 wherein R is a hydrocarbon radical having a number average molecular weight between about 800 and about 3000.

6. A method according to claim 5 wherein a and b are each 1.

7. A method according to claim 6 wherein both positions ortho to the hydroxy groups in reagents A and B are unsubstituted.

8. A method according to claim 7 wherein R is para to the hydroxy group.

9. A method according to claim 8 wherein up to two X's and up to two Y's are alkyl or hydroxyalkyl radicals having up to 2 carbon atoms and all other X's and Y's are hydrogen.

10. A method according to claim 8 wherein all X's and Y's are hydrogen.

11. A method according to claim 10 wherein the oxidative coupling agent comprises oxygen in combination with a catalyst prepared by combining a copper salt with an amine.

12. A method according to claim 11 wherein the copper salt is a cuprous salt and the amine is a tertiary amine.

13. A method according to claim 12 wherein the amine is pyridine and the cuprous salt is cuprous chloride.

14. An oxidatively coupled product prepared by the method of any of claims 1-10.

15. A composition comprising the solid and liquid components of an oxidative coupling agent in combination with:

(A) At least one hydroxyaromatic compound containing no aliphatic substituent having more than 4 carbon atoms; and (B) at least one hydroxyaromatic compound containing at least one aliphatic substituent having at least about 12 carbon atoms;

at least one position ortho to a hydroxy group in each of reagents A and B being unsubstituted.

16. A composition according to claim 15 wherein reagents A and B have the formulas

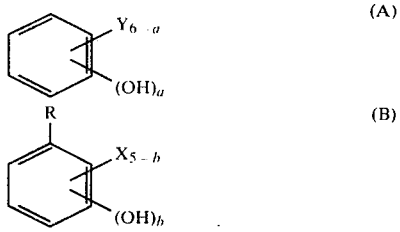

wherein R is an aliphatic radical having at least about 12 carbon atoms; each X and each Y is individually hydrogen, halo, alkyl or hydroxyalkyl or haloalkyl of up to 4 carbon atoms, or alkoxy or alkylthio of up to 4 carbon atoms; and each of a and b is 1 or 2.

17. A composition according to claim 16 wherein R has at least about 40 carbon atoms.

18. A composition according to claim 17 wherein R has a number average molecular weight between about 600 and about 5000.

19. A composition according to claim 18 wherein R is a hydrocarbon radical having a number average molecular weight between about 800 and about 3000.

20. A composition according to claim 19 wherein a and b are each 1.

21. A composition according to claim 20 wherein both positions ortho to the hydroxy groups in reagents A and B are unsubstituted.

22. A composition according to claim 21 wherein R is para to the hydroxy group.

23. A composition according to claim 22 wherein up to two X's and up to two Y's are alkyl or hydroxyalkyl radicals having up to 2 carbon atoms and all other X's and Y's are hydrogen.

24. A composition according to claim 22 wherein all X's and Y's are hydrogen.

25. A composition according to claim 24 wherein the solid and liquid components of the oxidative coupling agent comprise a catalyst prepared by combining a copper salt with an amine.

26. A composition according to claim 25 wherein the copper salt is a cuprous salt and the amine is a tertiary amine.

27. A composition according to claim 26 wherein the amine is pyridine and the cuprous salt is cuprous chloride.

28. An additive concentrate comprising a substantially inert, normally liquid organic diluent and from about 20% to about 90% by weight of an oxidatively coupled product according to claim 14.

29. A lubricating composition comprising a major amount of a lubricating oil and a minor amount of an oxidatively coupled product according to claim 14.

30. A fuel composition comprising a major amount of a normally liquid fuel and a minor amount of an oxidatively coupled product according to claim 14.

* * * * *